US007814578B2

(12) United States Patent
Kosel et al.

(10) Patent No.: US 7,814,578 B2
(45) Date of Patent: Oct. 19, 2010

(54) HELMET WITH INTEGRATED HEAD LIGHT

(75) Inventors: Bradley S. Kosel, Thief River Falls, MN (US); Timothy W. Benedict, Thief River Falls, MN (US)

(73) Assignee: Arctic Cat Inc., Thief River Falls, MN (US)

( * ) Notice: Subject to any disclaimer, the term of this patent is extended or adjusted under 35 U.S.C. 154(b) by 712 days.

(21) Appl. No.: 11/061,371

(22) Filed: Feb. 17, 2005

(65) Prior Publication Data

US 2006/0179553 A1 Aug. 17, 2006

(51) Int. Cl.
*A42B 1/24* (2006.01)

(52) U.S. Cl. ..... 2/422; 2/6.2

(58) Field of Classification Search ..... 2/410, 2/6.1–6.7, 422, 9
See application file for complete search history.

(56) References Cited

U.S. PATENT DOCUMENTS 4,092,704 A * 5/1978 Malm ..... 362/106
4,667,348 A * 5/1987 Sundahl ..... 2/410
4,862,331 A * 8/1989 Hanabusa ..... 362/106
5,394,566 A * 3/1995 Hong ..... 2/424
5,797,146 A * 8/1998 Matich ..... 2/424
6,249,918 B1 * 6/2001 Lacroix ..... 2/424
6,795,979 B2 * 9/2004 Fournier ..... 2/424
6,859,946 B2 * 3/2005 Fournier et al. ..... 2/424
2004/0227628 A1 * 11/2004 Burdick ..... 340/479

OTHER PUBLICATIONS

"Bombardier Helmet BV2S Operator's Manual." Bombardier Inc. 2003:7pp.

* cited by examiner

*Primary Examiner*—Shaun R Hurley
*Assistant Examiner*—Andrew W Sutton
(74) *Attorney, Agent, or Firm*—Black Lowe & Graham PLLC

(57) ABSTRACT

A helmet is provided herein for protection of the head of a user. A shell, chin bar, breath deflector, and head light are provided. The chin bar is fixed between the right and left sides of the shell. A face shield system is pivotally secured to the shell to pivot up and away from the face of the user leaving only a chin bar running below the mouth of the user in front of the face of the user. The breath deflector moves with the face shield. The light is secured to a center portion of the chin bar and includes a switch integrated with the light.

21 Claims, 4 Drawing Sheets

HELMET WITH INTEGRATED HEAD LIGHT

FIELD OF THE INVENTION

This invention relates generally to protective headgear and, more specifically, to helmets with removable faceshields.

BACKGROUND OF THE INVENTION

Helmets are generally available in two varieties, full-faced and open-faced. An open faced helmet includes a shell to protect the cranium of the user while leaving the face exposed. These helmets have the advantage of allowing the user to communicate more freely with others, as the user's mouth is visible. The user is also able to consume food and beverages without removing the helmet. Furthermore, even if such an open-faced helmet includes a wind deflection shield or the user wears goggles, such shields and goggles do not normally fog from the user's breath, as the breath is able to exit unimpeded. However, these open-faced helmets do not protect the face of the user in the event of a crash. Crashes can be especially severe in motor-sports activities, such as riding motorcycles, all-terrain vehicles, or snowmobiles. Without facial protection, the user may sustain serious injury.

Full-faced helmets were developed to better protect the face of the user. Such helmets include a broad, rigid face shield that extends around the front of the user's face from the right and left sides of the cranium shell. The face shield extends in front of the mouth of the user below the eyes. A breath deflector is often used in full-faced helmets to channel the breath away from the eye shield or goggles of the user so as to minimize fogging. The face protection advantages of these helmets are substantial, however, the helmet complicates eating, drinking or communicating without complete removal of the helmet.

Helmets with pivoting face shields do not have a structurally sufficient frontal support to protect the user's face in the event of a crash. They are simply elaborate wind-shields, not sufficient for crash protection.

Therefore, a need exists for a helmet that provides the safety of a fixed chin bar and the convenience of an open-faced design.

SUMMARY OF THE INVENTION

The present invention provides a helmet with a fixed chin bar but having a face shield system that opens to expose the face, including the mouth, of the user. Invention also provides a head light in the chin bar.

Specifically, a helmet is provided comprising a shell, a rigid chin bar, and a light. The shell is constructed for protecting the cranium of a user. The rigid chin bar is attached to the shell. The light is secured within the chin bar.

In a further aspect of the invention, a switch is located on the helmet for activating the light. A rear light is further secured to a rear portion of the shell. Preferably, the light includes a light emitting diode.

In a further aspect of the invention, the chin bar is fixed relative to the shell and extends from a right side of the shell to a left side of the shell. The helmet further includes a face shield movably attached to the shell. A face shield is selectively positionable either over the face of the user or substantially away from the face of the user. Preferably, the face shield includes a breath deflector. A shield lens and a visor are also preferably provided. The shield lens is movably secured to the shell and is movable independent of the remainder of the face shield. The shield lens may also be movable with the face shield at the option of the user. In the preferred embodiment, the shield lens is movably secured to the shell through a pivotal connection to the face shield. The visor is preferably secured to an upper portion of the face shield to move with the upper portion of the face shield system The present invention also includes a helmet comprising a shell, a chin bar, and a face shield. A shell protects the cranium of a user. A shell includes a right side and a left side. The chin bar is fixedly attached to the shell on both the right and left sides of the shell. The chin bar extends between the right and left sides of the shell. The face shield is movably secured to the shell to be positioned by the user between the position covering the mouth of the user and the position substantially away from the face of the user. The face shield system is movable independent of the chin bar. Preferably, the chin bar includes a center portion between the right and left sides of the shell. The light is secured to the center portion.

The invention may also be defined as a helmet including a shell, a chin bar, and a breath deflector. A chin bar extends between and is fixed to the right and left sides of the shell. The chin bar extends forward of the chin of the user, below the mouth of the user. The breath deflector is movably coupled to the shell. The breath deflector is movable between a position in front of the mouth of the user and a position away from the face of the user. Preferably, the breath deflector is movably secured directly to the shell with a pivotal connection. The breath deflector is selectively positionable in front of the mouth of the user and above the face of the user.

BRIEF DESCRIPTION OF THE DRAWINGS

The preferred and alternative embodiments of the present invention are described in detail below with reference to the following drawings.

DETAILED DESCRIPTION OF THE PREFERRED EMBODIMENT

The preferred embodiments of the invention will now be described in connection with the above-referenced figures.

Figure 1:
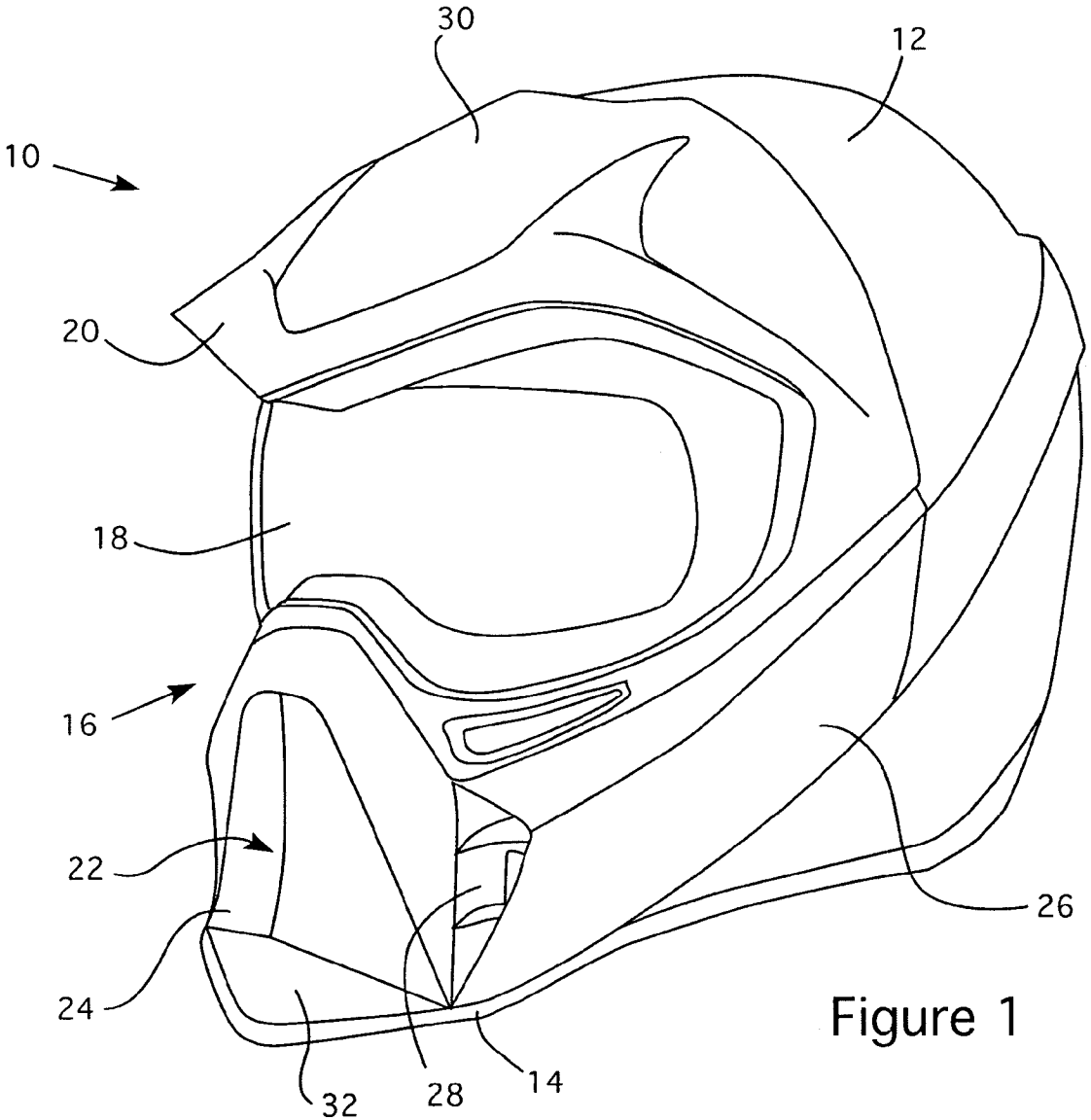
FIG. 1 is a front perspective view of the present invention with the face shield closed.

As seen in FIG. 1, a helmet 10 is provided for protecting the head of a user. In the preferred embodiment, the helmet is preferably for use with motor sports vehicles, such as snowmobiles, ATVs, and motorcycles. However, the same aspects may also be used with other helmet applications such as for non-motorized sports or other activities where the head of the user is to be protected. In any such uses, specific materials and details of construction may be altered. For example, for non-motorized sports, a lighter weight helmet may be employed that does not need to meet the higher impact necessities of a motor sports helmet.

Helmet 10 preferably includes a shell 12, a chin bar 14, and face shield system 16. Shell 12 is the main structural body of the helmet and is positioned to cover at least the cranium of the user for protection of the user's head. Shell 12 may be constructed of polycarbonate, other plastics, fiberglass, carbon composites, or other composites. Preferably, strong, durable, light-weight materials are selected for the construction of shell 12. Chin bar 14 is likewise constructed with strong materials. Chin bar 14 extends from a right side of shell 12 to a left side of shell 12 in front of, and preferably slightly below the face of a user. Chin bar 14 is integrated into the sides of shell 12 in the preferred embodiment. Alternatively, chin bar 14 may be separately affixed to the right and left sides of shell 12. For example, a curved bar extending from one side of the other of shell 12 may be used. Chin bar 14 is used to protect the entire face of a user such that chin bar 14 holds the user's face away from an impact surface during a crash. Thus, helmet 10, in its preferred embodiment, has distinctive advantages over open-faced helmets that do not provide facial protection during a crash.

Face shield system 16 includes an assembly that covers the face of the user from a portion of shell 12 adjacent the top of the forehead of the user to below the chin of the user, in the preferred embodiment. Face shield system 16 includes a lens 18, a visor 20, and a chin shield 22. Visor 20 is at the top of face shield system 16 and is attached to a face shield frame 30. Face shield frame 30 nests over the top of a forward portion of shell 12. Visor 20 is secured to face shield frame 30 and projects outwardly to provide a shade effect from the sun or to protect lens 18 from debris and other objects such as brush, branches, or airborne objects as the user may encounter them. In the preferred embodiment, visor 20 has a modified "eyebrow" shape arching up above the eyes and meeting in the middle.

Lens 18 is secured below visor 20 and includes a lens rim 38 (preferably part of face shield frame 30) at the bottom edge thereof. Lens 18 protects the user from air, water, or other things that may blow past the face of the user during activities in which the helmet is used. Lens 18 is preferably not heavily tinted so that the user may use lens 18 in place during low light conditions. However, in alternate embodiments, a tint or coloring may be applied to lens 18. Lens rim 38 is preferably formed as part of face shield frame 30. Alternatively it is formed of a soft flexible material, such as rubber or soft plastic to engage the edges of lens 18 and allow replacement of lens 18 as desired.

Chin shield 22 mates with the lower portion of lens 18 and lens rim 38 and covers the region between lens rim 38 and chin bar 14. Chin shield 22 includes a chin cover 24 and side arms 26. Vents 28 also open between chin cover 24 and side arms 26. Vents 28 allow ventilation to enter into the interior of helmet 10. These vents may have selectable closures for regulating the amount of venting desired. Vents may alternatively be disposed in the forward face of chin cover 24. Chin cover 24 extends from a region just above the front of the nose of the user to just below the chin of the user. Side arms 26 extend back from the lateral sides of chin cover 24 to a moving, preferably pivotal, connection with shell 12 as explained below. Side arms 26 extend below the sides of lens 18 and lens rim 38 to smoothly contour face shield system 16 with shell 12.

A head light 32 is provided within the forward portion of chin bar 14 directly below chin cover 24. In the preferred embodiment, head light 32 has a diamond configuration abutting chin cover 24 when closed. Head light 32 preferably includes a switch, such as a pressure activation switch directly beneath head light 32. Thus, the user may simply press on the face of head light 32 to switch it on or off. Other switching mechanisms may alternatively be used. Positioning head light 32 within fixed chin bar 14 is advantageous for the user of helmet 10 since the user may position face shield system 16 upwardly away from the user's face while still using head light 32 for various purposes such as map reading. Head light 32 is alternatively positioned on visor 20 or face shield frame 30. However, such positioning would either not allow the portion of face shield system 16 to be pivoted upwardly or it would block the light from head light 32. Ideally the user will have his or her view unimpeded by any part of face shield system 16 while using head light 32 in non-riding situations. Center positioning of head light 32 is also preferable. This position provides a projection of light directly in front of the user's field of vision in the direction that the user positions his or her head.

Figure 2:
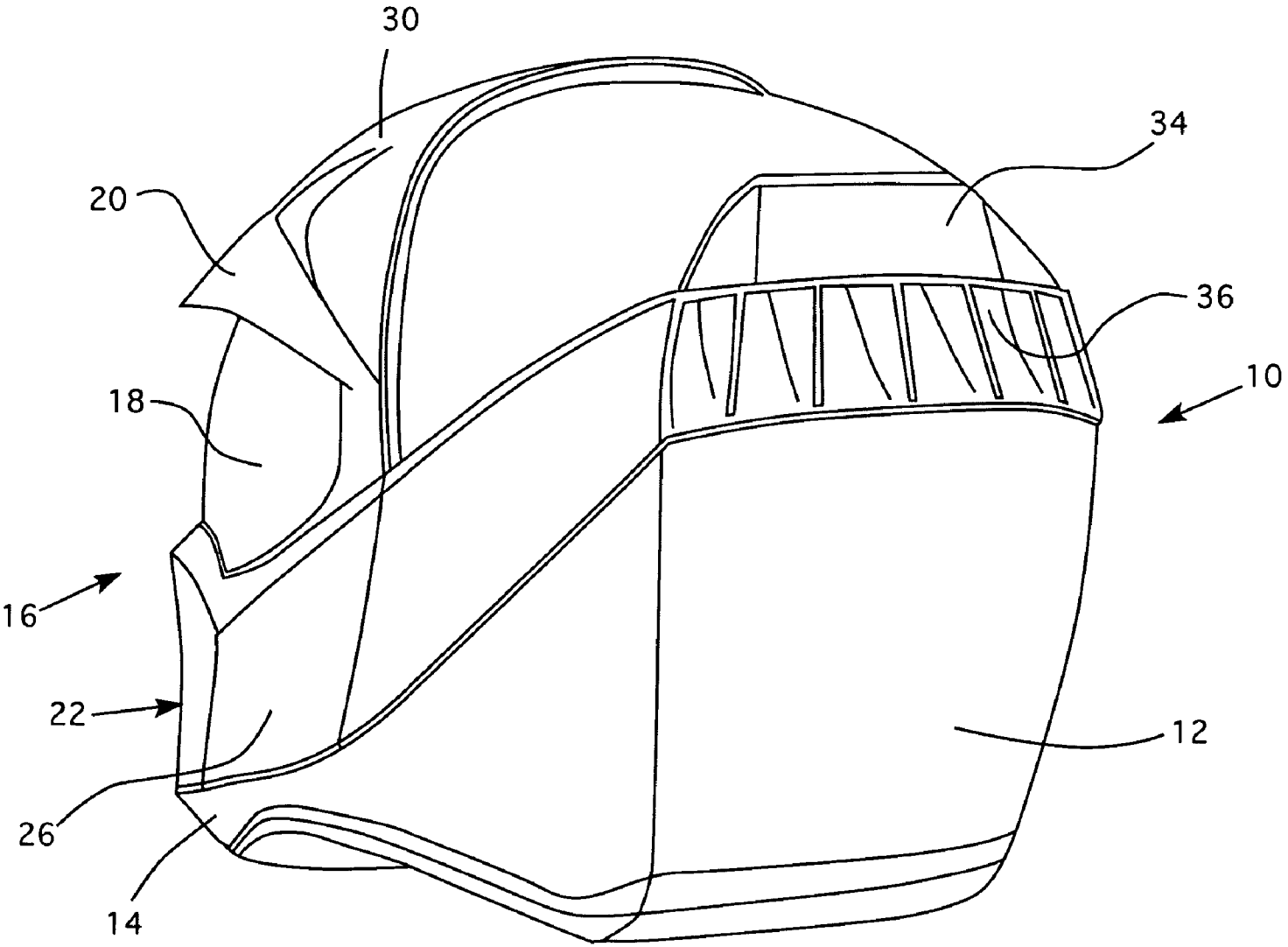
FIG. 2 is a rear perspective view of the helmet.

As seen in FIG. 2, an integrated tail light 34 may also be employed. Tail light 34 is preferably positioned at the rearward side of the helmet in a slight recess or cut-out within shell 12. Tail light 32 is also preferably light-emitting-diode (LED) based with a blinking function. Both head light 32 and tail light 34 may be connected to the same power source or may be independently powered.

FIG. 2 also illustrates a preferred arrangement of a rear vent 36 at the rear of the helmet. Air is preferably channeled through the helmet and allowed to exit rear vent 36.

Figure 3:
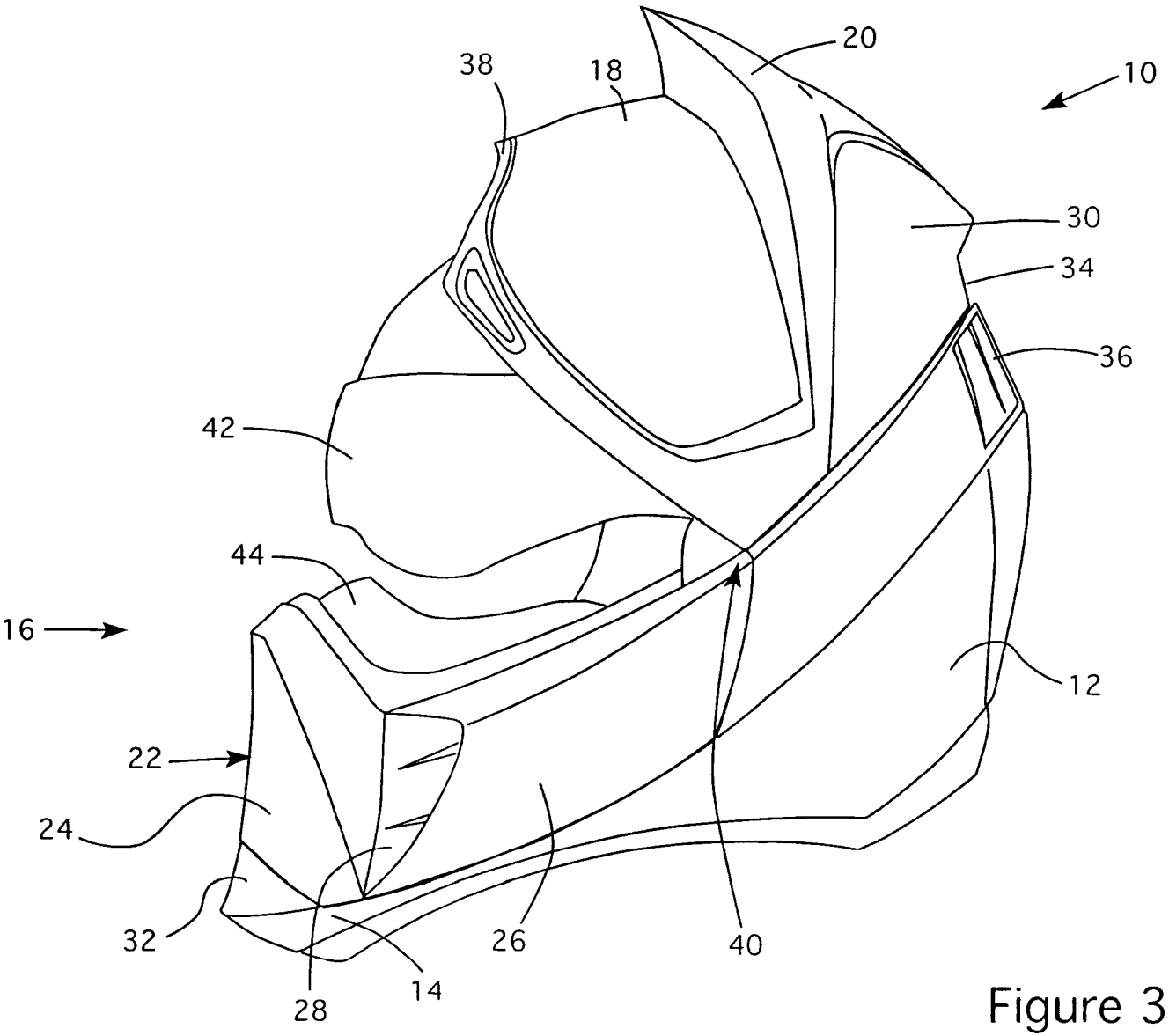
FIG. 3 is a side-elevational view of the helmet with the lens and visor raised.

Turning now to FIG. 3, the movement of lens 18 with visor 20 away from the face of the user is illustrated. A pivot location 40 is provided in shell 12 for a pivot connection such that face shield frame 30, visor 20, and lens 18 with lens rim 38 all pivot upwardly together away from the face of the user to above shell 12 of helmet 10. This portion of face shield system 16 is pivotable away from the face of the user independent of chin shield 22. A sun shield 42 may also remain over the eyes of the user or may be pivoted upwardly independent of lens 18 and visor 20. Thus, sun shield 42 may be pivoted upwardly or downwardly separate from the pivoting of these outer eye shield elements. Sun shield 42 is preferably a shaded plastic sun screen visor that helps filter the sun when used over the eyes of the user. Under low light conditions, sun shield 42 may be nested between face shield frame 30 and shell 12.

Figure 4:
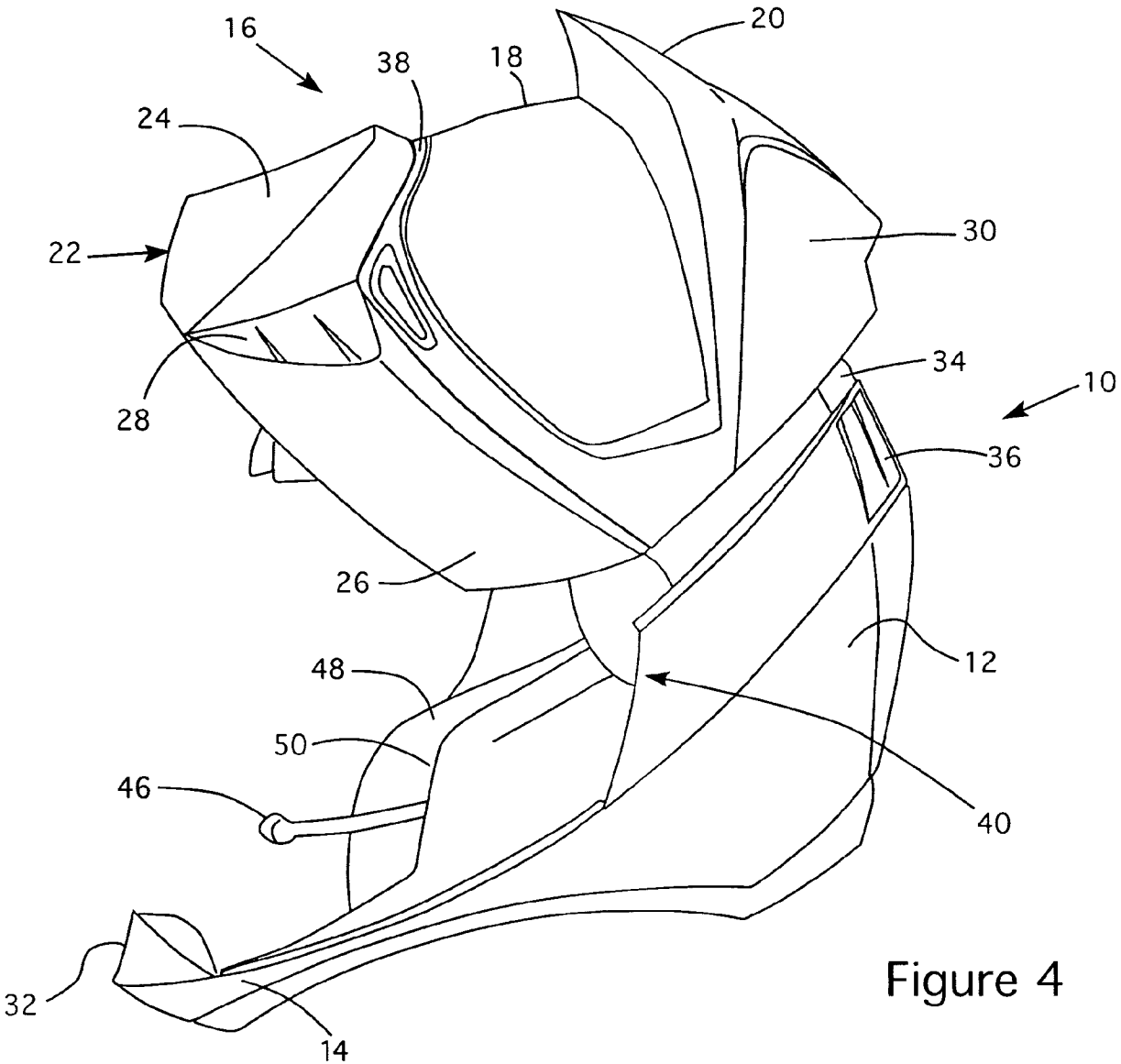
FIG. 4 is a side-elevational view of the helmet with the entire face shield raised.

FIG. 3 also illustrates the placement of breath deflector 44 that extends from and is part of chin shield 22. Breath deflector 44 is preferably a flexible foam with a plastic holder material that extends inwardly from chin cover 24 and side arms 26 to contour to the face of the user. It is disposed adjacent the face of the user on top of the user's nose and along the user's cheeks adjacent to the user's nose and mouth. Breath deflector 44 functions to direct the breath of the user away from lens 18 and sun shield 42 to minimize fogging of these screens. As illustrated in FIG. 4, breath deflector 44 pivots upwardly and away from the face of the user along with chin shield 22 when the user desires full facial exposure.

The positioning of face shield system 16 as illustrated in FIG. 4 provides the advantage of allowing the user to expose his or her entire face for communication and extended vision, especially in non-riding situations, such as during brief stops. The user may want to maintain the helmet on his or her head for increased warmth and for convenience such that the helmet does not have to be removed and handled. This also aids the user to eat or drink with the helmet still worn.

In contrast to helmets that include a face shield that is removable by positioning above the face of the user, the helmet of the present invention maintains a structural chin bar extending from the lower sides of shell 12 such that it functions as a full face helmet for safety purposes. The fact that most of the face shield system pivots away still allows most all of the conveniences of an upward based helmet while providing the safety features of a full face helmet. Furthermore, head light 32 is able to be positioned on fixed chin bar 14 for convenient use with face shield system 16 pivoted away and above the face of the user.

Also visible in FIG. 4 is a communications microphone 46 that may optionally be employed with helmet 10. A communication system is preferably integrated into the helmet.

Cheek supports 48 extending from and attached to shell 12 along with cheek pads 50 are also illustrated. These elements are not visible when face shield system 16 is positioned over the face of the user, but provide additional support, safety, and comfort to the user.

The entire face shield system 16 may be pivoted upwardly as a single piece by pivoting chin shield 22 upwardly. Chin shield 22 interfaces with lens rim 38 to pivot lens 18 and visor 20 upwardly with chin shield 22. Alternatively, if lens 18 is already pivoted upwardly, chin shield 22 may be pivoted upwardly independently. It may also be brought down independently from visor 20. Various locking and/or detent mechanisms for the pivot mechanism, generally in pivot location 40, may be employed.

Various alternate embodiments of the present invention may be employed. For example, a full face helmet may be employed with the chin bar light as illustrated herein where the chin shield is non-pivotally secured, but fixed to the fixed chin bar. Another alternative may employ a light on a movable, non-fixed chin bar. The light in such embodiment is still on a lower forward portion of the chin bar and is aimable to shine downwardly and forwardly even with the face shield open. Another embodiment may involve a non-separable visor and chin shield where the combination still pivots upwardly and away from the face of the user. All of these various possible embodiments share inventive features with that described in detail above.

The embodiments of the invention in which an exclusive property or privilege is claimed are defined as follows:

1. A helmet comprising:

a protective shell for protecting a cranium of a user;

a structurally continuous, stationary chin bar fixed to the shell and stationary relative to the shell and extending from left and right lower portions of the shell, the chin bar having a front portion being positioned generally in front of and below the mouth of the user;

a face shield assembly having a transparent lens and a non-transparent chin shield selectively moveable together and separately relative to the shell, wherein the lens and chin shield are rotatable relative to and separable from the structurally continuous, stationary chin bar, the face shield assembly configured to expose a substantial portion of a face of the user, including exposing the face directly in front of the mouth of the user when both the lens and chin shield are rotated upward and separated from the structurally continuous, stationary chin bar; and a lighting device coupled to the structurally continuous, stationary chin bar, the lighting device oriented to project light substantially toward a region corresponding to a field of vision of the user even when the lens and chin shield are rotated upward relative to the structurally continuous, stationary chin bar.

2. The helmet of claim 1, further comprising a switch on said helmet for activating the lighting device.

3. The helmet of claim 1, further comprising a rear light secured to a rear portion of said shell.

4. The helmet of claim 1, wherein the lighting device includes a light emitting diode for producing the light.

5. The helmet of claim 4, further comprising a switch on said helmet for activating the lighting device.

6. The helmet of claim 1, wherein the face shield assembly is selectively positionable over the face of the user and configured to cover a substantial portion of the face of the user when the face shield assembly is rotated downward relative to the structurally continuous, stationary chin bar, the chin shield being positioned below the lens, the chin shield and lens of the face shield assembly being moveable together or separately in front of the chin and eyes of the wearer, respectively.

7. The helmet of claim 1, wherein the face shield assembly further includes a visor coupled to the lens and a breath deflector coupled to the chin shield.

8. The helmet of claim 1, wherein the face shield assembly is rotatable to cover a top portion of the shell when rotated upward relative to the structurally continuous, stationary chin bar.

9. A helmet comprising:

a shell for protecting a cranium of a user, the shell having a right side and a left side;

a stationary, structurally continuous chin bar fixed to and extending from the right and left sides of the shell to a position in front of and substantially below the mouth of the user, the chin bar being stationary relative to the shell; and a face shield assembly having a transparent lens and a non-transparent chin shield, the face shield assembly rotationally coupled to the shell such that the lens and chin shield are moveable in unison between a first position covering a substantial portion of a face of the user and a second position exposing the substantial portion of the face of the user, including exposing the face in front of the mouth of the user, the face shield assembly moveable independent of the stationary, structurally continuous chin bar, wherein the face shield assembly is located approximately on a top portion of the helmet when in the second position, wherein the stationary, structurally continuous chin bar is configured to protect the face of the user from an impact surface during a crash when the face shield assembly is in any position.

10. The helmet of claim 9, wherein the face shield assembly further includes a visor and a breath deflector.

11. The helmet of claim 10, further comprising a light secured to the chin bar.

12. The helmet of claim 11, wherein the structurally continuous chin bar includes a center portion located between the right and left sides of the shell and the light is secured to the center portion.

13. A helmet comprising:

a protective shell for protecting a cranium of a user;

a stationary, structurally continuous chin bar fixed to the shell and extending from left and right lower portions of the shell, the chin bar having a front portion being positioned generally in front of and below the mouth of the user;

a face shield assembly having a transparent lens and a non-transparent chin shield, the face shield assembly rotationally coupled to the shell and independently rotatable relative to the stationary, structurally continuous chin bar, the face shield assembly configured to expose a substantial portion of a face of the user, including exposing the face directly in front of the mouth of the user when both the lens and chin shield are moved in unison upward and away from the stationary, structurally continuous chin bar, and wherein the chin bar is configured to substantially expose a portion of the face of the user in front of the mouth of the user when the face shield assembly is rotated upward and away from the stationary, structurally continuous chin bar.

14. The helmet of claim 13, further comprising a lighting device coupled to the stationary, structurally continuous chin bar, the lighting device oriented to project light substantially toward a region corresponding to a field of vision of the user even when the face shield assembly is rotated upward relative to the stationary, structurally continuous chin bar.

15. The helmet of claim 13, wherein the lighting device includes a light emitting diode for producing the light.

16. The helmet of claim 13, wherein the face shield assembly is selectively positionable over the face of the user and configured to cover a substantial portion of the face of the user when the face shield assembly is rotated downward relative to the stationary, structurally continuous chin bar, the lens being separately upwardly moveable when the chin shield is in a down position and the chin shield being downwardly separately moveable when the lens is in an up position.

17. The helmet of claim 16, wherein the face shield assembly includes a visor and a breath deflector.

18. The helmet of claim 13, wherein the stationary, structurally continuous chin bar is integrated with the left and right lower portions of the protective shell a front portion of the chin bar being in front of and below the level of the mouth of the user.

19. A helmet comprising:

a protective shell for protecting a cranium of a wearer;

a stationary, structurally continuous chin bar fixed to the shell and extending from left and right lower portions of the shell, the chin bar extending in front of and below the level of the mouth of the user for substantially full access to the face of the user while still providing impact protection to the face; and a lighting device coupled to the stationary, structurally continuous chin bar, the lighting device arranged to project light forward outward away from the eyes of the wearer.

20. The helmet of claim 19, wherein the lighting device is located on a forward portion of the stationary, structurally continuous chin bar below a chin cover and arranged to direct a concentrated beam of light substantially along a line of sight of the wearer, such that the wearer can see articles at least in the near line of sight.

21. The helmet of claim 20, wherein the lighting device is configured with a diamond-shaped configuration.

* * * * *